United States Patent [19]

Eastman

[11] Patent Number: 4,707,941

[45] Date of Patent: Nov. 24, 1987

[54] BULK CARTRIDGE MAGAZINE FOR FIREARMS AND PROCESS FOR LOADING

[76] Inventor: Peter M. Eastman, 4701 Grouse Dr., West Richland, Wash. 99352

[21] Appl. No.: 874,645

[22] Filed: Jun. 16, 1986

[51] Int. Cl.[4] ..... F41C 25/02

[52] U.S. Cl. ..... 42/50; 42/49.02; 42/87; 42/88

[58] Field of Search ..... 42/87, 88, 6, 49.01, 42/49.02, 50.0

[56] References Cited

U.S. PATENT DOCUMENTS

| | | | |
|---|---|---|---|
| 452,447 | 5/1891 | Bruce | 42/88 |
| 1,227,439 | 5/1917 | Hilgendorf | 42/50 |
| 1,797,951 | 3/1931 | Gaidos | 42/50 |
| 2,014,177 | 9/1935 | Herlach et al. | 42/50 |
| 2,147,208 | 2/1939 | Nolan | 42/50 |
| 2,345,031 | 3/1944 | Carithers | 42/50 |
| 2,488,233 | 11/1949 | Pelo | 42/50 |
| 3,345,771 | 10/1967 | Silsby | 42/50 |

FOREIGN PATENT DOCUMENTS

| | | | |
|---|---|---|---|
| 111381 | 8/1925 | Sweden | 42/88 |

*Primary Examiner*—Deborah L. Kyle

*Assistant Examiner*—Michael J. Carone

*Attorney, Agent, or Firm*—Wells, St. John & Roberts

[57] ABSTRACT

A quick load magazine and loading process are described by which bulk cartridges can be transferred from a cartridge box to a magazine and from the cartridge magazine to the firing mechanism of a firearm in a quick and efficient manner. The magazine includes mechanisms facilitating a loading process by which the cartridge box is successively opened and cartridges are dropped gravitationally into the magazine as the box is opened. Guide mechanisms receive the cartridges within the magazine and align the cartridges into successive substantially parallel columns. Spring mechanisms bias the columns toward a magazine interface that is received by the magazine well of the associated firearm. Springs urge the columns upwardly such that one column of cartridges is fed through the interface to the firing mechanism of the weapon until depleted. At the instant one cartridge column is depleted, another column is pivoted into alignment with the interface and the associated spring mechanism operates to bias that column of cartridges into the interface. The procedure continues until the bulk loaded quantity of cartridges are depleted.

33 Claims, 21 Drawing Figures

FIG 6
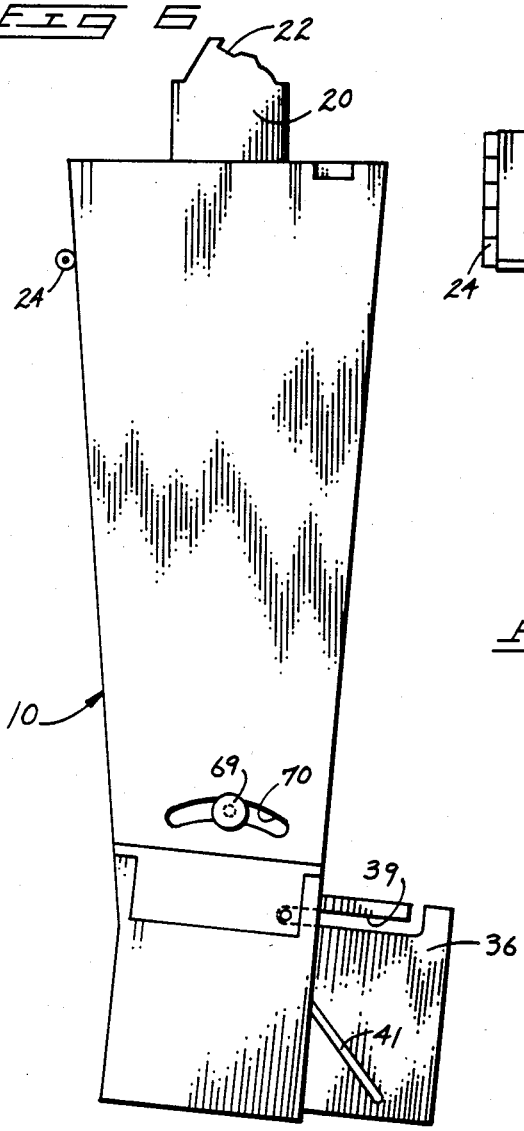
FIG 7
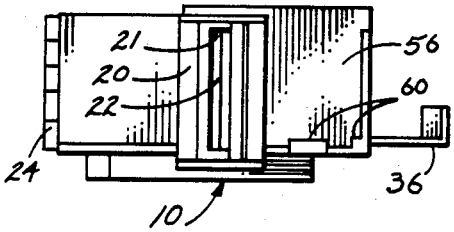
FIG 9
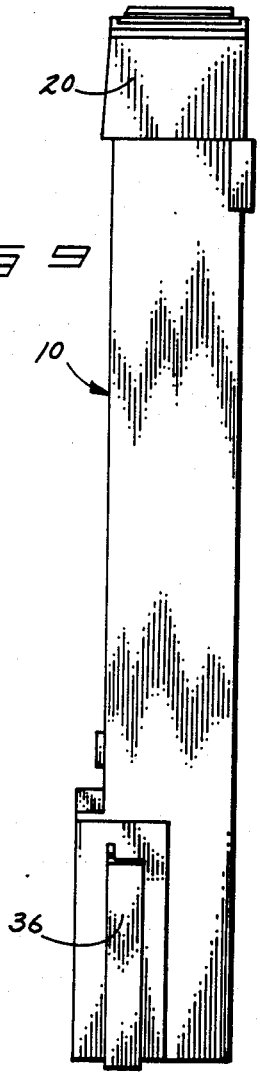
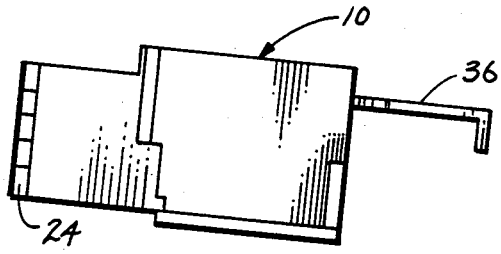
FIG 8

FIG 10
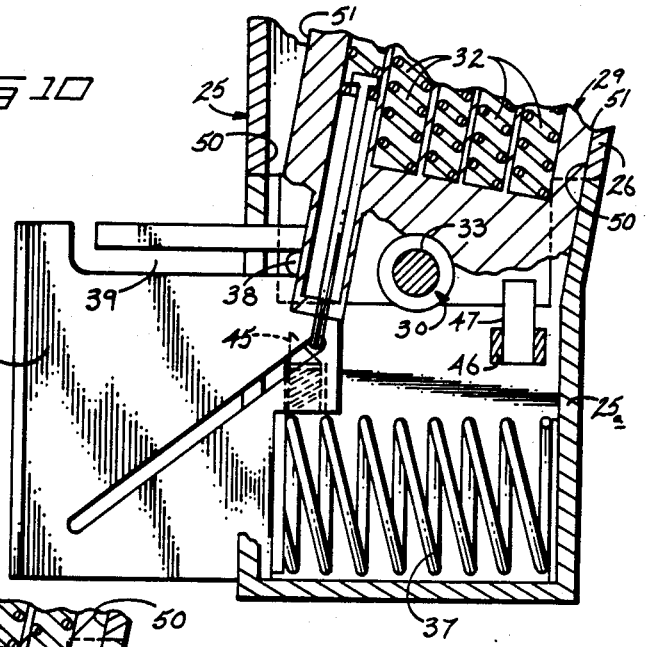
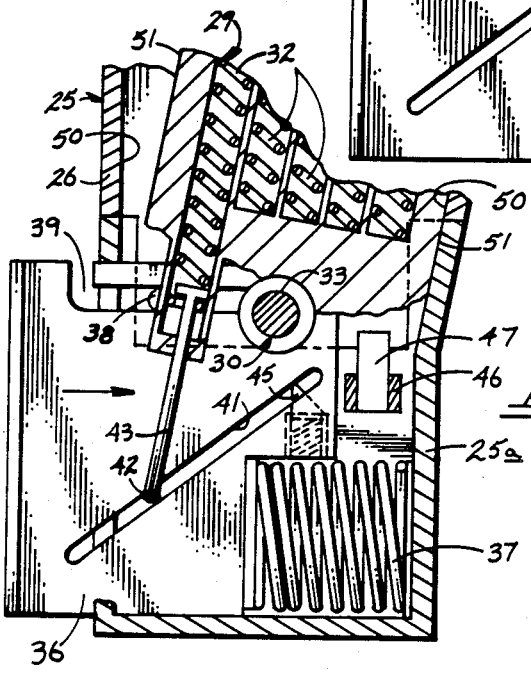
FIG 11
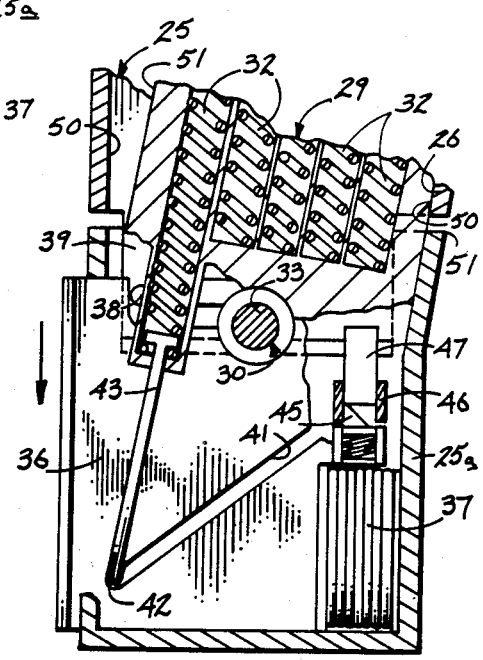
FIG 12

BULK CARTRIDGE MAGAZINE FOR FIREARMS AND PROCESS FOR LOADING

FIELD OF THE INVENTION

The present invention relates to bulk cartridge magazines for firearms and to bulk loading of such magazines.

BACKGROUND OF THE INVENTION

Developments in automatic, semi-automatic, and other "repeater" firing mechanisms in modern firearms have led to the need for a cartridge feed system that will supply successive cartridges to the firing mechanism at a rate equal to the operating speed of the weapon. In the case of automatic and semi-automatic weapons, the feed rate can be substantial. Large capacity magazines have thus been developed which are capable of feeding cartridges successively to the firing mechanisms.

A typical form of cartridge magazine is the "clip"—a spring loaded case that is removably mounted to the firearm adjacent the firing mechanism. The spring mechanism within the clip is used to urge cartridges in a direction transverse to the cartridge lengths in succession from one or more columns to the firing mechanism. Each column is biased by one or more springs toward a single discharge end of the magazine. Such "clips" have been found to be reliable feed mechanisms, even for automatic weapons. A serious drawback, however, has been realized in loading the magazines with cartridges.

Many clips require that each individual cartridge be manually loaded. It is not at all unusual to observe a situation in which one or more minutes are spent loading the clip, followed by a firing session in which the magazine is depleted of cartridges in a matter of seconds. This situation quickly becomes a frustration for the sports shooter. It can also become a life-threatening situation in combat.

One solution to the problem has been the use of multiple magazines. When one magazine empties, another can be used to quickly take its place. This solution is only partially satisfactory. Magazines are fairly expensive items. They take up more space than the cartridges they contain and so add significant bulk to a cartridge belt. Furthermore, multiple magazines add excess weight to ammunition carriers. The multiple magazine solution does not remove the need for the magazines to be loaded by hand, at least in many non-military instances.

Another partial solution has been the development of large capacity magazines. Such magazines enable the shooter to continue firing over extended periods of time. However, extended periods of time are also required for reloading a large capacity magazine. Multiple large capacity magazines certainly extend the firing time and reduce the overall amount of time taken to discharge a given number of cartridges. However, the reloading time for the magazines is not reduced.

A need therefore remains for a large capacity magazine, having the attendant advantages of providing a large number of cartridges for firing but which also includes quick magazine reloading capability. This need is recognized yet not completely fulfilled by the apparatus disclosed in the following U.S. patents.

U.S. Pat. No. 2,014,177 to Herlach et al discloses a box magazine for automatic loading firearms. This magazine is provided with a hinged lid that permits access to the magazine interior for loading purposes. A manually retractable spring mechanism is also provided, operated by a lever mechanism such that the spring can be retracted, leaving an opening area in which cartridges can be inserted. This enables cartridges to be quickly loaded, perhaps even in groups, but no provision is disclosed for permitting bulk loading directly from a cartridge box.

U.S. Pat. No. 2,488,233 to Pelo discloses a magazine having a pivoted cover for allowing access to the magazine interior for cartridge loading purposes. The cover opens in a manner similar to that disclosed above in the Herlach reference with the exception that the cartridge biasing spring is automatically retracted as the cover is opened. Again, there is no specific provision for bulk loading of the cartridges into the access area of the magazine.

U.S. Pat. No. 2,147,208 to Nolan discloses a bulk capacity magazine arrangement. This device is comprised of a number of individual magazines mounted to a weapon for rotation about an axis substantially parallel with stacks of the loaded cartridges. Each stack can be rotated about the axis into alignment with the magazine well of the firearm. Each magazine section also includes a spring for biasing the stack of cartridges upwardly. Loading may be accomplished using a conventional clip feed arrangement by which a stack of cartridges can be fed into the individual magazine compartments. The device is somewhat bulky since the cartridges are arranged with their axes oriented radially with respect to the rotational axis of the magazine assembly. Angular spaces required between the radial columns increases overall bulk of the device. Furthermore, a continuous fire situation is not feasible in such apparatus since there is no mechanism by which cartridges in the magazine well of the weapon are biased toward the firing mechanism during rotation of the magazine assembly from an unloaded section to the next loaded section.

U.S. Pat. No. 3,345,771 to Silsby discloses a high capacity magazine which includes two substantially parallel compartments for receiving cartridges and feeding the individual cartridges to a single discharge opening. A gate mechanism is provided near the discharge opening for selectively releasing cartridges from one or the other magazine compartment. There is no disclosed provision enabling bulk loading of cartridges into the magazine. Instead, it is assumed the magazine must be loaded in the conventional manual manner, one cartridge at a time, through the single top opening of the magazine.

U.S. Pat. No. 1,227,439 to Hilgendorf discloses a cartridge magazine in which two parallel columns of cartridges are pivotably carried within a magazine compartment. The columns are pivoted in relation to the chamber of the firearm such that successive cartridges from one column can be fed toward the chamber. Then, when the first column is depleted, the second column can be pivoted into alignment to feed successive cartridges to the breech. Pivotal motion is accomplished by a leaf spring mechanism acting against the upright side of the cartridge guide. A specific mechanism is provided for enabling pivotal motion of the cartridge columns. Such mechanism involves modification of the magazine well for the weapon in order to effectively pivot the columns of cartridges to an initial, angular starting position within the weapon.

Of the above known apparatus, none includes the provision for quick loading of large or bulk quantities of ammunition into a single magazine directly from a cartridge box and in which the magazine is capable of operation to deliver the bulk quantities of cartridges to a weapon firing mechanism. No complete solution has been available, to the present applicant's knowledge, until advent of the present invention.

BRIEF DESCRIPTION OF THE DRAWINGS

A preferred embodiment of the present invention is illustrated in the accompanying drawings in which;

FIG. 6 is a rear elevation view of the magazine;

FIG. 7 is a top plan view;

FIG. 8 is a bottom plan view;

FIG. 9 is a side view of the present magazine as seen from the right in FIG. 6;

FIGS. 10–12 are enlarged fragmented sectional views illustrating operation of a manually actuatable lockout mechanism, FIG. 10 being taken substantially along line 10—10 in FIG. 5;

DETAILED DESCRIPTION OF THE PREFERRED EMBODIMENT

Figure 1:
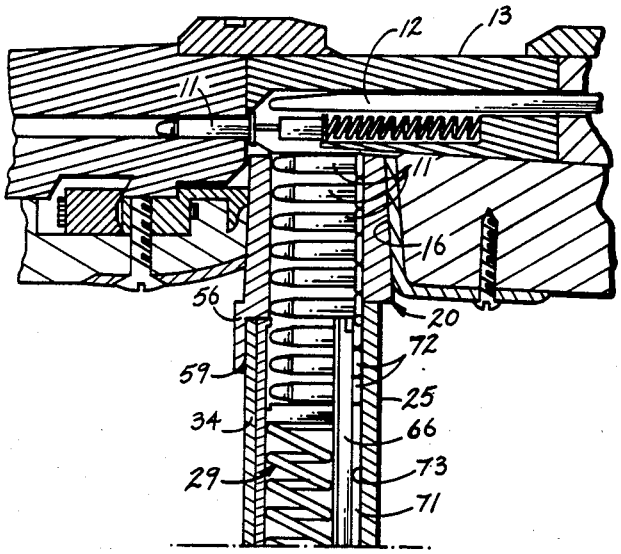
FIG. 1 is a diagrammatic sectional view taken through a portion of the magazine and breach of an associated firearm.

In compliance with the constitutional purpose of the Patent Laws "to promote the progress of science and useful arts" (Article 1, Section 8), applicant submits the following disclosure of the invention.

A General Description

The present invention is embodied in a magazine and loading process for small arms cartridges. The present magazine is capable of being quickly loaded with a bulk quantity of firearm cartridges as generally shown in the drawings by the reference numeral 11. The magazine 10, when loaded, can be fitted to the magazine well 16 of an appropriate firearm 13 for the purpose of automatically feeding successive cartridges to the bolt and receiver 12 of the firearm.

The present magazine and loading system may be utilized in conjunction with a variety of conventional small arms cartridges and is therefore not intended to be limited to the rim fire cartridges 11 generally shown in the accompanying drawings. Furthermore, the present magazine and loading process is adaptable for use with a variety of small arms weapons without requiring modification of the weapon itself. Rather, the present magazine can be fitted to the associated weapon in place of the existing conventional "clip".

Use of the present device may be preferred in conjunction with semiautomatic small arms weapons. It is conceivable, however, that the present magazine and loading system may also be used with automatic weapons or, alternatively weapons having other conventional forms of actions (bolt action, etc.).

The present magazine and loading process allows for cartridge loading directly from a conventional cartridge box 14 without requiring intermediate handling of individual cartridges. The cartridges are simply unloaded from the box and simultaneously loaded into the magazine.

This is accomplished simply by opening the magazine to receive the cartridge box and by simultaneously opening the cartridge box while positioning it over cartridge receiving guides within the magazine. Cartridges will progressively drop from the box and into the appropriate receiving area of the magazine. Through this process, a selected number of cartridges, or the entire cartridge content of the box, can be quickly and easily loaded into the magazine.

Mechanisms are provided within the cartridge magazine for receiving the cartridges and holding them in a plurality of columns. In operation, full columns are moved successively, following depletion of prevous columns into alignment with a cartridge well interface 20 to the firearm receiver 12. Delivery of cartridges to the receiver may continue substantially uninterrupted through the entire quantity of cartridges previously loaded into the magazine.

Detailed Description

The above generalized description is given to provide a basic understanding of the present magazine and loading process, and as a base to enable a more thorough understanding of the below-described components and process steps.

The present magazine and loading process are intended for use in conjunction with conventional cartridge boxes 14 as generally described above. Such cartridge boxes are presently utilized commercially for packaging and dispensing rim fire cartridges, but could, with only minor modification, be utilized for other forms of small arm cartridges. The cartridge box 14 is typically formed of a transparent plastic material and is elongated in a rectangular configuration to receive and individually support a fairly large number of cartridges 11. Currently, commercially available cartridge boxes 14 typically contain 100 rim fire cartridges. Each cartridge is supported within the cartridge box as shown in FIG. 3 and generally in FIG. 2 in a specific orientation including five elongated columns of twenty cartridges each. The cartridges are also aligned within the box in twenty transverse rows with five cartridges in each row.

Figure 2:
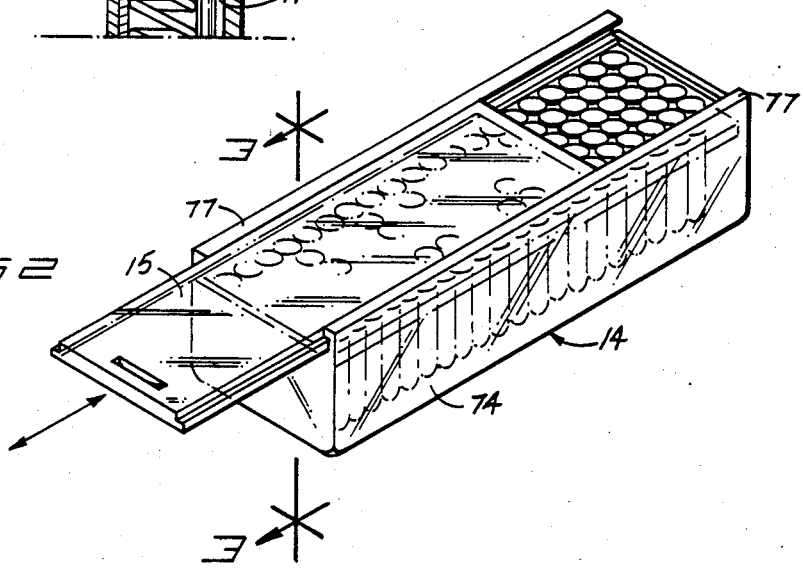
FIG. 2 is a perspective view of a standard cartridge box.
Figure 3:
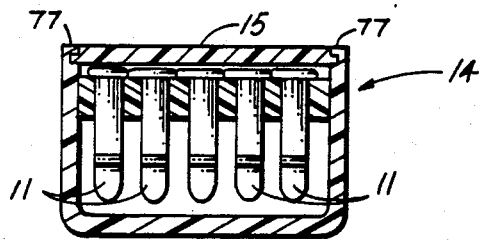
FIG. 3 is a somewhat enlarged sectional view taken substantially along line 3—3 of FIG. 2.

The cartridge box typically includes a lid 15 that may be slid longitudinally as indicated in FIG. 2 to expose the box contents. The lid can usually be slid in either longitudinal direction and, by doing so, successive rows of cartridges are exposed and can be dislodged from the box simply by turning it upside down and allowing the cartridges to drop gravitationally from their holders.

Conventional cartridge magazines, whether separate from or integral with an associated weapon, have in the past been loaded by the following, fairly tedious steps. Firstly, the cartridge box is opened by sliding the lid longitudinally along the box to expose a desired number of cartridges. By way of example, say the magazine to be loaded has a ten-cartridge capacity. The user would then slide the lid along the box to expose two rows of five cartridges. This is done typically using two hands, one to hold the cartridge box and the thumb of the other hand to push the lid along the box to expose the two cartridge rows. The user then holds the box in one hand and inverts it over the palm of the other hand. The ten exposed cartridges will then drop from the box into the palm of the waiting hand. The remaining cartridges in the box will be held by the box lid. The cartridge box is then set aside and the removed cartridges are loaded manually, one-at-a-time, into the firearm magazine. This again is usually a two-hand operation. In loading a cartridge clip that is removable from the firearm, for example, the clip is held in one hand while the other hand is used to insert individual cartridges. This requires that the cartridges previously held in the palm be placed on some other support surface so the cartridge magazine can be supported in that hand while being loaded. If there is no available clean surface to receive the cartridges, dirt can be accumulated on the cartridge casings to accumulate later within the magazine or firearm receiver, possibly causing fouling or corrosion. Furthermore, cartridges are easily lost in this process.

The present magazine and loading process enables bulk loading of cartridges. It does not require manual handling of individual cartridges and facilitates loading at such speed and convenience that the actual loading process may take considerably less time than any known previous manual loading operation without risking loss of cartridges or accumulation of dirt or corrosive materials on the cartridges from intermediate handling between the cartridge box and magazine.

The present magazine 10 includes a cartridge interface 20 that is shaped similarly to the conventional magazine that is to be replaced by the present magazine 10. It should therefore be understood that the interface 20 can take any of a multitude of forms. The interface shown generally in the drawings, for example, is shaped to emulate the exterior configuration of the conventional magazine for the "Ruger" brand rifle, model number "10-22".

The interface 20 is therefore shaped to be received and held within the magazine well 16 of an associated firearm such that the remainder of the magazine 10 is held in a corresponding position for feeding successive cartridges to the firing mechanism. The interface 20 is mounted at the top end of the magazine 10 so, when fitted to a firearm, the cartridge interface will be received within the magazine well and the remainder of the magazine will project downwardly from the firearm in the manner of a conventional "clip."

The cartridge interface as shown in FIGS. 15–19 includes a guide channel 21. Successive columns of cartridges are directed upwardly through the guide channel 21 to a top discharge opening 22. Each cartridge presented at the top opening 22 is positioned, as shown in FIG. 1, in proper orientation to be removed axially from the magazine and placed by the firearm bolt mechanism within the cartridge receiving chamber of the firearm barrel. Spring mechanisms (described below) continuously urge the successive columns of cartridges upwardly such that the top discharge opening 22 of the interface is continuouly supplied with a cartridge so long as any cartridges remain within the magazine.

The guide channel of the cartridge interface opens downwardly into a magazine case 25. The magazine case is generally provided to house or enclose the cartridges and internal mechanisms by which the cartridges are received from the cartridge box and by which the cartridges are eventually fed through the guide channel 21 to the top discharge opening 22.

Figure 13:
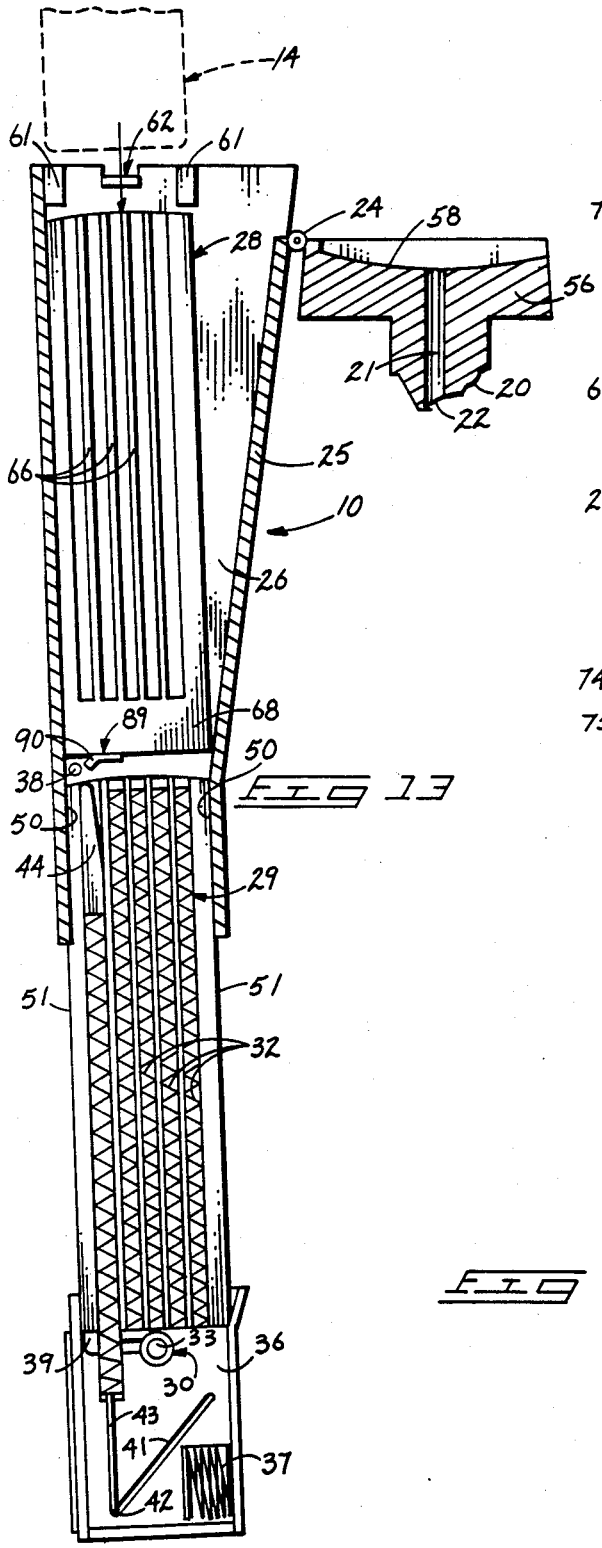
FIGS. 13–14 are sectional views illustrating the present process by which cartridges are loaded in bulk within the present magazine.

A base section 26 of the magazine case hingedly mounts the interface 20 such that the interface and adjacent components can be pivoted from the operative position shown in FIGS. 15–19 to an inoperative position as shown in FIG. 13 for loading purposes. Location of the interface hinge 24 is important in that such positioning of the hinge enables the user to leave the interface in position within the firearm magazine well 16 and simply pivot the remainder of magazine 10 to one side of the firearm for loading purposes. In other words, the magazine does not require removal from the firearm for loading purposes as do most other forms of conventionally available magazines.

Access means is generally designated at 27 in the drawings for exposing a guide means, generally shown at 28, for bulk cartridge charging directly from the cartridge box. A spring means 29 is associated with the guide means for selectively biasing columns of cartridges toward the interface means. A pivot means 30 is provided within the housing or magazine case 25 mounting the guide means 28 for movement therein such that each column of cartridges held by the guide means may be pivoted in succession into alignment with the guide channel 21. An indexing means 31 is provided for actuating the pivot means to move the successive columns into alignment with the guide channel. This is done in response to depletion of cartridges from the column presently in alignment with the guide channel 21. As one column is depleted, another is pivoted into position to replenish the supply of cartridges in the interface 20.

Figure 5:
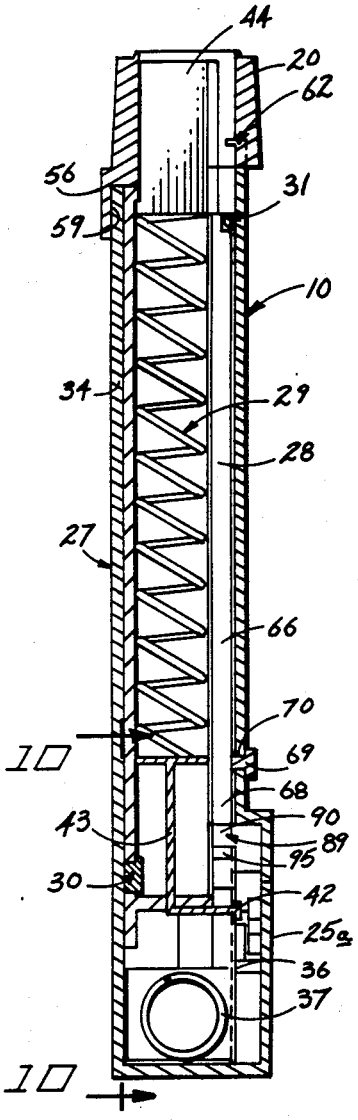
FIG. 5 is a sectional view of the magazine taken substantially along line 5—5 in FIG. 4.
Figure 14:
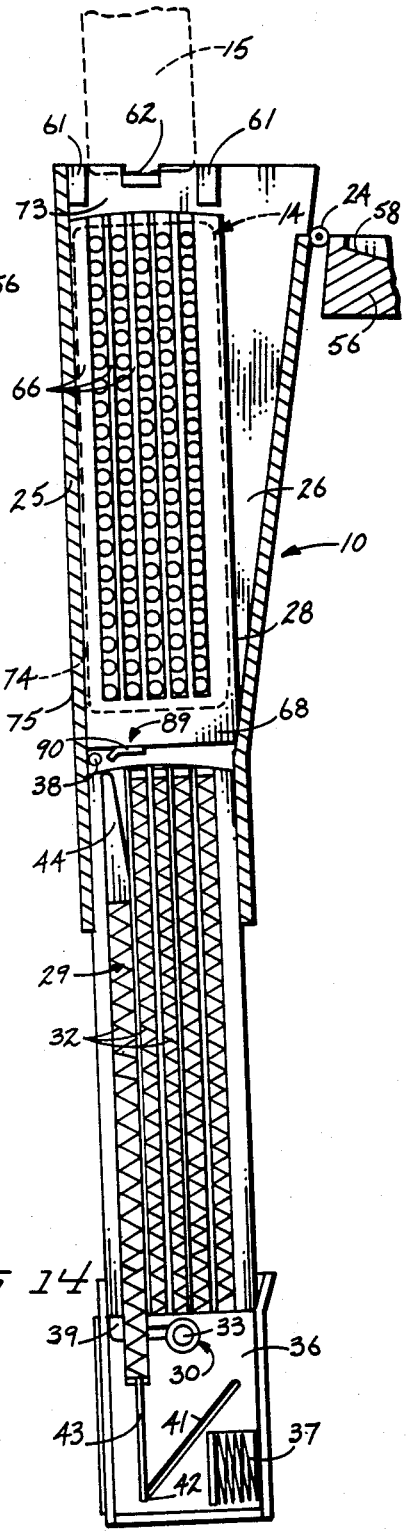
Figure 16:
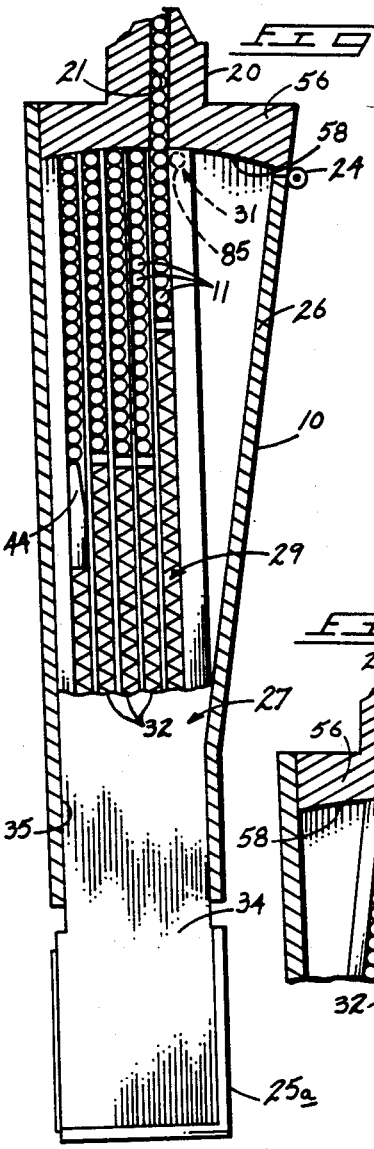
FIGS. 15–19 are sectional views illustrating operation of the present magazine to deliver a loaded bulk quantity of cartridges through the firearm interface.
Figure 17:
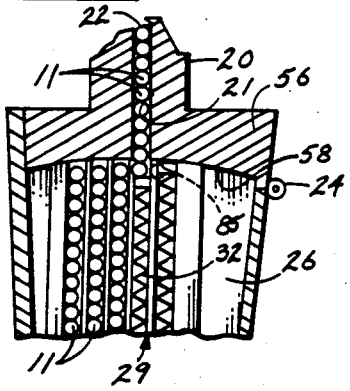
Figure 18:
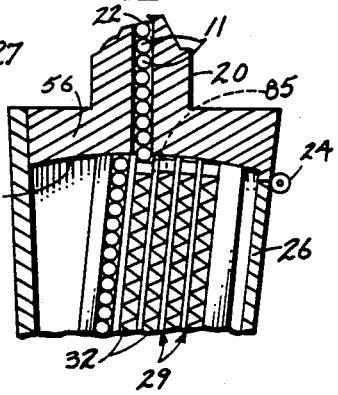

The spring means 29 is clearly shown in FIGS. 5 and 14. It is comprised of a number of spring columns 32. One spring is provided for each column of cartridges received by the magazine. In the preferred example shown, five individual springs are provided for receiving five individual columns of cartridges and for biasing the cartridges upwardly toward the interface 20 as shown in FIG. 16. The spring columns are supported within a carrier mounted by a pivot pin 33 to a slidable case cover 34. The springs and carrier will therefore pivot about the axis of pin 33 between the position shown in FIG. 16 and the position shown in FIG. 19. The pivot axis, when the magazine is mounted to a firearm, will be substantially parallel to the barrel axis.

Pivot pin 33 mounts the spring means 29 to the case cover for pivotal motion as described above, and for translational motion for loading purposes as indicated in FIGS. 5 and 16. There the spring columns are shown situated in an operative position. In FIGS. 13 and 14 the spring columns and cover are situated in an inoperative position to facilitate bulk loading.

The case cover 34 is an integral part of the access means 27 generally described above. The case cover 34 is movably mounted by slide means 35 to the case for translational movement between an operative position covering the cartridge guide means (FIGS. 4, 5), and an inoperation position in which the cartridge guide is exposed for loading (FIGS. 13, 14). The slide means is defined by parallel longitudinal guide ways that may be formed into the magazine case 25 to facilitate longitudinal translational motion of the cover between the two described positions.

Motion of the case cover and spring columns between the operative and inoperative positions is controlled by a manually actuatable lockout means generally shown in FIGS. 10–12. The lockout means is provided to interconnect the spring means and magazine case. It enables selective locking of the spring means in its operative position within the case. It also enables unlocking the spring means to permit motion thereof to an inoperative position as suggested in FIGS. 13 and 14 in which the spring means projects outwardly of the magazine means.

The lockout means may include a manually movable case unlocking plate 36 slidably mounted to a separable section 25*a* of the magazine case. The unlocking plate 36 may be outwardly biased by a spring 37 to the normal position shown in FIGS. 4, 6–8, and 10. A case locking pin 38 is provided as shown in FIGS. 10–12 on the magazine case base 26. The locking pin 38 is receivable within a locking slot 39 of the plate 36. The pin 38 and slot 39 interfit to lock the spring means and case base 26 in position when the plate is in the normal outwardly extended position as shown in FIG. 10. However, the plate can be manually moved inwardly to bring the pin into alignment with an upwardly facing opening of the slot. This movement is shown in progression from FIGS. 10–12.

As the slot is moved inwardly, the upwardly facing opening comes into alignment with the pin. This allows outward translational movement of the unlocking mechanism movable case section 25*a*, the interconnected cover 34, and slide means 35 starting from the initial separation shown in FIG. 12 to a fully extended and outwardly spaced position indicated in FIGS. 13 and 14.

During such outward translational motion, sides 51 of the spring columns are automatically pivoted due to a camming action against the magazine case guide walls 50, from the angular position indicated in FIGS. 10–12 and 19 to the upright orientation shown in FIGS. 13 and 14. The side edges 51 simply cam against the constricting guide walls 50 of the magazine case base 26 as separation and withdrawal occurs. The spring means thus automatically swings to the upright retracted orientation shown in FIGS. 13 and 14 as it is withdrawn from the magazine case.

Figure 19:
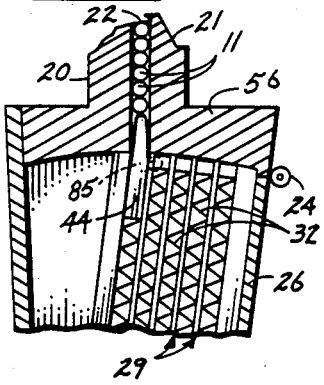
Figure 15:
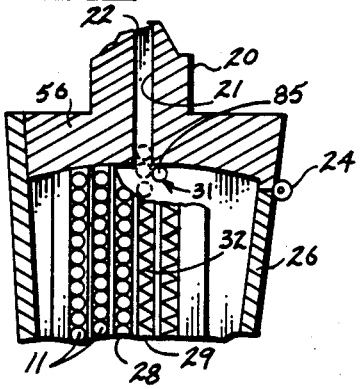
Figure 20:
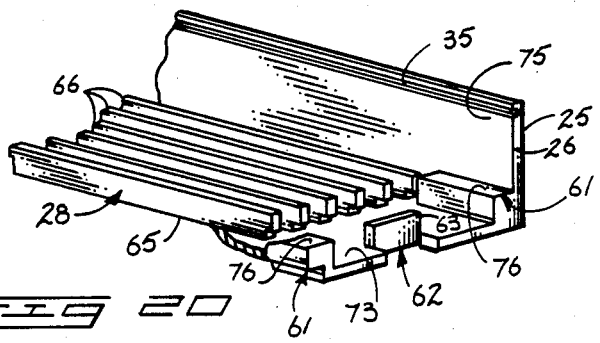
FIG. 20 is a fragmented pictorial view of a cartridge box lid stripping means.

In order to free the spring guides for pivotal motion between the position shown in FIG. 19 and the retractable positions shown in FIGS. 13 and 14, provision is made to automatically withdraw an interface follower 44 (FIG. 19) from the interface as the unlocking plate 36 is moved progressively inwardly from the position shown in FIG. 10 to the position shown in FIG. 12. To accomplish this, a cam slot 41 is provided along the unlocking plate 36. The cam slot 41 is angled or otherwise formed to extend from an upper end adjacent an upper edge of the plate toward the lower, outward plate edge.

A follower pin 42 is slidably received within the cam slot. Pin 42 is connected to a retraction rod 43 which, in turn, is connected through an associated spring column to the interface follower 44. The cam action between slot 41 and follower pin 42 is such that as the unlocking plate 36 is manually moved inwardly as indicated by the arrow in FIG. 11, the follower pin 42 and attached retraction rod 43 are pulled downwardly. This results in corresponding downward motion of the associated spring column and attached interface follower 44. Full inward motion of the unlocking plate 36 therefore causes corresponding retraction of the interface follower 44 completely from the guide channel 21. This action permits relatively free pivotal motion of the spring means 29 to the positions shown in FIGS. 13 and 14.

Provisions are made between the case unlocking plate 36 and associated separable portion of the magazine case 25 to selectively lock the plate 36 in the position shown in FIGS. 12–14. This is done to hold the interface follower 44 in its retracted position during the cartridge loading procedure. Mechanism used for locking the plate 36 in its inward position is shown in FIGS. 11 and 12. The mechanism may include a spring biased case lock open wedge 45 movably mounted on the case locking plate 36. The wedge 45 is releasably received by a capture frame 46 on the separable section 25*a* of the magazine case. The capture frame 46 also releasably receives a stationary wedge release 47 provided on the case base 26.

As the locking plate 36 moves inwardly, the wedge 45 engages and cams downwardly while sliding into position below the capture frame 46. The wedge 45 will not pop into the capture frame, since that space is presently occupied by the wedge release 47. However, upon retraction of the slide means and associated assembly, the capture frame 46 and wedge release 47 separate from one another as shown in FIG. 12. This permits the lock open wedge 45 to slide upwardly into the capture frame 46. The wedge 45 and capture frame 46 will therefore hold the unlocking plate 36 in the closed position until the locking plate and associated mechanism including the spring means is pushed back upwardly to close the magazine case. As this happens, the capture frame 46 moves upwardly to receive the stationary wedge release 47. The received release 47 progressively depresses the wedge 45 until its upward tip is free to slide over the adjacent bottom end of the capture frame 46. This enables the unlocking plate spring 37 to move the unlocking plate back out to its normal outwardly extended position (FIG. 10). As this happens, the cam slot 41 slides the follower pin 42 back upwardly, positioning the spring column and interface follower for operable engagement with the previously received column of cartridges above.

The interface 20 is mounted as briefly indicated above, to the magazine case by the interface hinge 24. This hinge is attached to the interface through an interface lid structure 56 that is clearly shown in FIGS. 13 and 15–19. The interface 20 and lid 56 pivot selectively from the closed position shown in FIGS. 15–19 and the open position shown in FIG. 13.

The lid 56 includes an arched cartridge bearing surface 58 that leads to the open bottom end of the cartridge guide channel 21. The bearing function of the arched surface 58 is shown graphically in FIGS. 15–19.

Figure 4:
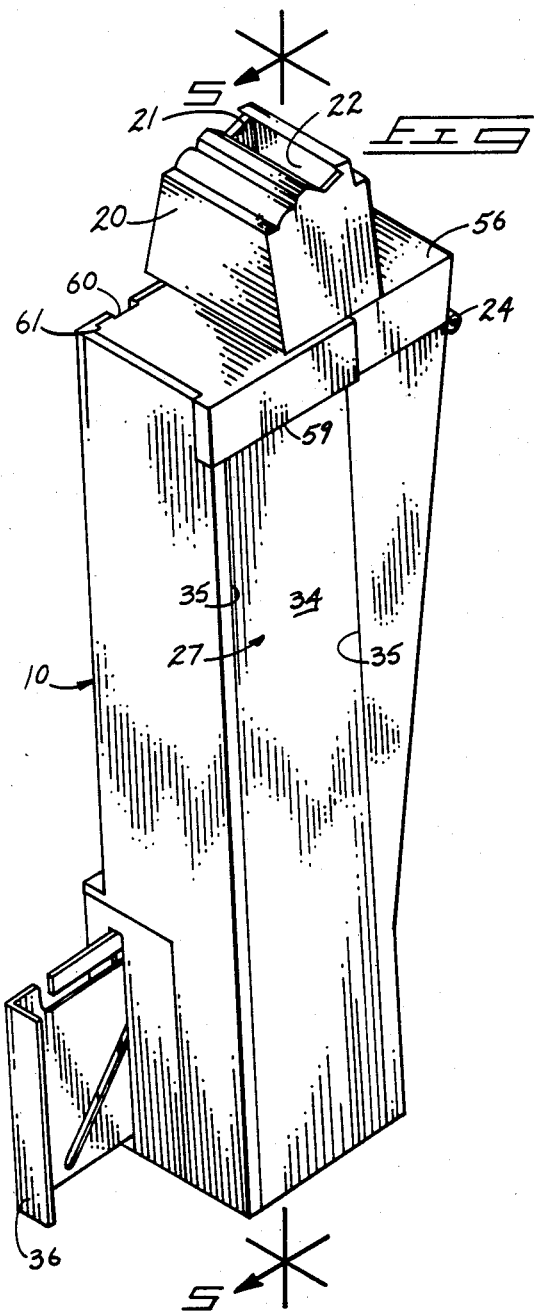
FIG. 4 is a perspective view of the present magazine.

A case cover receiving recess 59 is also provided on the interface lid 56 (FIGS. 4 and 5). The recess 59 is provided to receive the case cover 34 in the closed position thereof in order to lock the lid 56 from swinging open. The case cover, in this position, interfaces with free swinging motion of the lid and therefore holds the lid and interface securely in position on the magazine case until such time that the case cover is moved translationally outward with the spring means 29 through operation of the unlocking mechanism described above.

The magazine case base 26 and interfce lid 56 are therefore positively locked together (FIGS. 4 and 5) until such time that the lock plate mechanism is actuated to unlock the spring means and permit outward sliding motion of the spring means and case cover for cartridge loading purposes. At that time, the case cover 34 slides outwardly from its interference fit with the cover receiving recess 59. The lid 56 and case base 26 are then free to pivot to one another toward the relationship indicated in FIG. 13. This exposes the upward end of the case base 26 and guide means 28 for receiving and orienting cartridges in the loading sequence to be described below.

The hinged interface lid 56 is also provided with arched grooves 60 on a radius from the hinge 24. These grooves 60 loosely receive cartridge box guide means 61 provided on the case base 26. The grooves 60 also loosely receive a cartridge box lid stripping means 62 that is used, along with the guide means 61, in the cartridge loading process to be described in greater detail below.

The guide means 28 generally described above is preferbly provided in the form of elongated guide fingers 66 that are spaced apart and are supported within the magazine case to receive and organic cartridges into substantially parallel column. The guide fingers 66 extend from top ends 67 to a common base end 68 where the fingers are joined and mounted by a slide pin 69 to the case base 26. The slide pin 69 is movably received within an arched slot 70 formed in the case base 26. The slot is preferably formed on a radius from the pivot pin 33 when the spring means is situated in the closed, operative position as shown in FIG. 5. The pin and arched slot are best viewed in FIG. 6.

The arched slot and pin arrangement allow for sliding movement of the guide fingers along with the spring means from the position indicated in FIG. 16 to the position indicated in FIG. 19. This motion allows for the successive columns of cartridges to be brought into alignment with the cartridge interface guide channel 21.

The guide fingers 66 are separated from the case base by a space 71 (FIG. 21) to allow clearance for cartridge rims 72. The space 71 is defined by an inside surface 73 of the case base 26 and surfaces 65 of the guide fingers 66.

The catridge box lid stripping means and catridge box guide means 62, 61 are bet understood with reference to FIGS. 13, 14, and FIGS. 20, 21. The guide means 61 is provided for receiving and guiding a cartridge box for manual translational movement along the guide means. The cartridge box lid stripping means is provided for opening the box during such translational motion. This enables transfer of cartridges held within the cartridge box gravitationally to the guide means between the open top ends 67 of the fingers 66.

Figure 21:
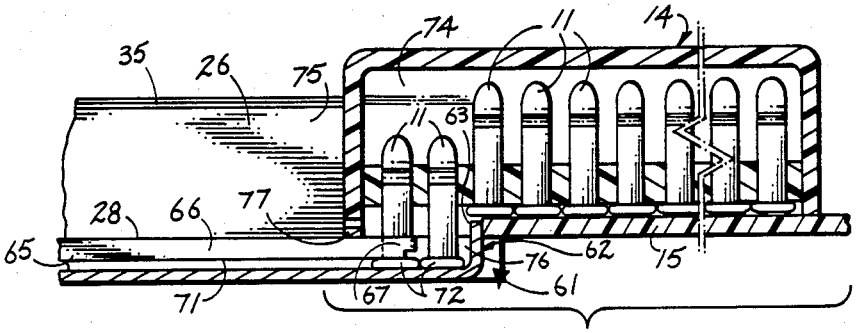
FIG. 21 is a diagrammatic sectional view illustrating the stripping means shown in FIG. 20 in operation in conjunction with a cartridge box, lid, and cartridges.

The cartridge box guides 61 may be formed of integral portions of the magazine case base 26 where one of the walls 75 thereof functions to slidably receive a corresponding side wall 74 of the cartridge box 14. Inwardy extending ribs 76 may also be formed at the upward end of the case base 26 for supporting and guiding the top edges 77 of the cartridge box. The relationship of the cartridge box and ribs 76 is best illustrated in FIG. 21. The base wall and ribs 76 will support and guide the case box as it is moved from an initial position shown by dashed lines in FIG. 13 to the position shown by dashed lines in FIG. 14. During this motion, the box lid stripping means 62 will function to remove the lid and allow cartridges to drop partially from the box and into the magazine guide means 28.

The stripping means 62 may be comprised of a tab 63 formed integrally in the case base 26. The tab 63 extends slightly above the ribs 76 to provide an abutment for engaging an end of the cartridge box lid 15 as the box is moved longitudinally over the guide means 61. The stationary tab will engage and hold the lid stationary while the box moves above. This action strips the lid from the box as the box is moved along over the cartridge guide means. Support for the cartridges enclosed within the box is therefore removed as the lid is stripped. The cartridges may then drop gravitationally from the box to the inside surface 73 of the case base.

The guides are positioned so that cartridges will only drop partially from the box so continued longitudinal motion of the box will cause corresponding longitudinal motion of the cartridges into the guide means 28. Space is provided between the top ends of the guide fingers 66 and stripping tab 63 so the cartridges can drop to the surface 73 and subsequently be slid under the finger surfaces 65.

The guide fingers 66 receive the cartridges being loaded and align them in substantially parallel columns. The fingers are spaced apart by distances only slightly greater than the diameter of the cartridge cases and by a distance less than the diameter of the cartridge rims. The cartridges are therefore confined by the guide fingers 66 against axial movement within the magazine. The guide fingers, however, will allow movement of the cartridges transverse to their lengths toward the interface 20 as urged by the spring means 29.

The indexing means 31 briefly described earlier is shown in FIG. 5 and operationally in FIGS. 15–18. The indexing means is simply comprised of an indexing button 85 provided as abutment means on the magazine case 25. It releasably engages successive cartridges at the open top end of the guide fingers as the cartridges are fed by the spring means toward the guide channel. The button 85 is used to prevent pivotal movement of the guide means only so long as cartridge remains in a column presently aligned with the guide channel. The button permits incremental pivotal motion of the guide means and spring means to the right as viewed in FIGS. 16 and 17 as one column of cartridges becomes depleted and the last cartridge therein is pushed from the guide means into the interface channel. At this time, the cartridge moves from contact with the button 85 and the guide guide means and spring means are allowed to shift to the right (again with reference FIGS. 16 and 17), bringing the next cartridge column into contact with the button and in alignment with the interface channel 21.

A biasing means is provided in the form of a spring 90 situated at the base end 68 of the guide fingers 66. The biasing means is provided for urging the guide means to pivot the columns of cartridges toward the cartridge guide channel 21. The spring 90 is clearly visible in FIGS. 13 and 14. It is simply a "leaf" type spring having one end secured to the guide finger base 68 and an outward end for engagement with an abutment 95 of the separable magazine case section **25*a*. The spring 90 is therefore relaxed and inoperative in FIGS. 13 and 14 positions, but is flexed and operative when the spring and case cover are moved to the closed FIGS. 4 and 5** positions.

The free spring end engage and is compressed by the abutment 95 (FIG. 5) on the separable case section **25*a*** as it is moved to the closed and locked position indicated in FIG. 10. As this happens, the spring 90 acts against the interfitting spring means 29 and guide means 28 about the axis of the pivot pin 33. Since the spring is positioned to the left side to pivot pin 33 (with reference to FIGS. 13 and 14), compression of the spring will result in a tendency for the spring means 29 and guide means 28 to pivot from the position shown in FIG. 16 toward the position shown in FIG. 19. This pivotal motion is interrupted by the button 85 which will permit pivotal motion only after a column of cartridges presently aligned with the interface channel 21 becomes depleted. At such time, the guide means and spring means is allowed to pivot toward the button 85 until such time that a cartridge in a successive column engages the button. The button 85 is placed so that such engagement will not occur until the cartridge column is aligned perfectly with the interface channel 21.

Feeding of the cartridges of the column can then be accomplished by action of the associated spring column until that particular cartridge column has been depleted. As the bottom shell of the column leaves contact with the button 85, the spring 90 is again free to shift the spring means 29 and guide means 28 another increment to bring another successive column of cartridges into alignment with the interface channel. This process is repeated until the last column of cartridges has been depleted.

FIG. 19 illustrates a situation in which the columns of cartridges previously held by the guide means and biased upwardly by the spring means have been depleted except for several cartridges remaining within the interface guide channel. These cartridges are fed through the interface channel by the extended follower 44 which, by action of the associated spring column, urges the cartridges upwardly toward and into the interface until the last cartridge is removed. The magazine is then completely emptied of cartridges and is in condition for refilling.

Operation of the present invention and the present loading process may be described starting with the magazine completely empty as just described above. In this situation, the extended follower 44 is positioned well within the confines of the interface guide channel 21 such that the top end of the follower is occupying the space previously occupied by the top cartridge in FIG. 19. The magazine is, at this stage, completely devoid of cartridges.

The several steps taken to bring the magazine into condition for the loading process are as briefly set forth below. The user first grasps the bottom end of the magazine case such that the fingers extend over the outwardly projecting unlocking plate 36. The thumb of the hand is preferably positioned opposite the plate 36 on the adjacent side surface of the magazine case. The grip is then tightened to cause inward movement of the unlocking plate 36 toward the position shown in FIG. 12. As this happens, the extended follower 44 is automatically retracted from the guide channel 21 and the case locking pin 38 is freed from the locking slot 39. The same hand can then be used to grip the separable case section 25*a* and pull it outwardy from the case base 26. During this action, the upwardly open end of the locking slot 39 slides from engagement with the stationary locking pin 38 and the entire separable section 25*a* of the case, along with the spring columns 32 and pivot pin 33 move outwardy toward the position shown in FIG. 13. As this outward motion occurs, side edges 51 of the spring columns engage guide walls 50 of the magazine case. The walls 50 cam the spring means 29 to the left about the pivot pin/33. The pivoting spring means also causes corresponding pivotal sliding motion of the interconnected guide means 28 to the position shown in FIG. 13. The retracting spring columns side outwardly between the guide fingers leaving them exposed to freely receive cartridges in the loading process.

The biasing spring 90 is also disengaged during this motion, so there is no tendency for the spring means 20 or guide means 28 to shift back about the axis of pivot pin 33.

The outward motion of the spring means 29 and interconnected case cover 34 also serves to unlock the interface lid 56 and magazine case base 26. This permits free pivotal motion of the case base 26 away from the interface and express the cartridge box guide means 61 and stripping means 62 for loading purposes.

It is pointed out that the above operational steps may be taken with the interface in position within the magazine well of the associated weapon. The following process steps for loading the cartridges into the magazine may also be accomplished without removing the interface from the weapon.

The process is initiated by orienting the magazine such that the cartridge receiving guide means 28 is substantially horizontal. This orientation is graphically shown in FIG. 21 wherein the guide means is horizontal and the cartridges are in upright orientation with the bullet ends thereof facing upwardly toward the top of the drawing sheet. The corresponding position of the weapon may be visualized (though not shown) with the barrel and muzzle pointing substantially vertically.

The next step of the loading process involves orienting the closed cartridge box such that the lid 15 or box closure faces downwardly. The box is then positioned in such a manner that an end is substantially supported on the magazine by the cartridge box guide means 61 along a plane substantially parallel to and above the cartridge guide fingers 66 and rim receiving case surface 73. The box lid 15 or closure is then engaged against the tab 63 which functions as a box opening means on the magazine. The cartridge box 14 is then moved relative to the tab 63 along the plane of the guide means 61 and over the guide fingers 66. The lid 15 or closure is progressively opened by abutment with the tab 63 and the cartridges within the box drop gravitationally and axially from the box onto case surface 73 and subsequently slide into the cartridge receiving guide means 28. This motion is continued as desired until a desired number of cartridges 11 are dropped gravitationally from the box 14 and slid translationally into the guide means 28. It is pointed out that as few as one row of cartridges 11 may be loaded, or as many as all the cartridges in the box 14 can also be loaded in this manner.

The final loading step is accomplished simply by removing the box 14 from the magazine 10. This is done by axially lifting the box (with relation to the cartridge axes) from engagement with the cartridges 11. In referring to FIG. 21, this motion would be completed simply by lifting the cartridge box upwardly. The cartridges that have been received and confined by the guide means will remain within the magazine and any cartridges remaining within the box and supported on the lid 15 will remain with the cartridge box 14. Any cartridges 11 remaining in the space between the guide finger ends 67 and tab 63 can then be pushed between the guide fingers 66 by using the lid 15 as a pusher. Alternatively, the magazine may simply be tipped up and lightly tapped to cause these cartridges to slide between the adjacent finger ends 67. This condition occurs only if less than the complete magazine contents are to be loaded. When all the cartridges are loaded, the box can be moved to the dotted line position shown in FIG. 14. There the cartridge box is shown with its full length having been moved over the guide fingers 66. The box has thus been used to slide all the cartridges contained therein securely between the fingers 66.

It is pointed out that the above process is accomplished without requiring the user to at any time handle individual cartridges or separate the cartridges from the box 14 to an intermediate holder such as the hand or another support surface. It is also pointed out that the loading procedure to this point may occupy a time frame of only a few seconds.

Once a sufficient number of cartridges have been loaded into the magazine, the interface lid 56 and magazine case 25 can be pivoted to a closed position and held closed while the spring means and cover means are moved back to close the magazine.

The access means 27 may now be closed to secure the cartridges in position and to bias them by actuation of the spring means 29 and biasing means 89 toward the cartridge interface 20 and guide channel 21. This is done simply by pushing the case cover 34 and spring columns 32 back to the original closed position. As this happens, the upward ends of the spring columns will engage the columns of cartridges. The springs will then compress against the cartridge columns as the cover and locking mechanisms are pushed to completely closed positions.

As the separable section 25*a* of the magazine moves to a completely closed position, the pin 38 is received in the locking slot 39 and the case lock open wedge 45 is forced from the capture frame 46 by the wedge release 47. This allows the unlocking plate 36 to be moved back to its outwardly extending position by action of the spring 37, securely locking the spring means 29, guide means 28 and the separable case section 25*a* in the closed position.

The biasing means 89 is also engaged by abutment 95 as the spring means and cover are moved back to close the magazine. The biasing spring 90 engages the abutment 95 and is compressed as the separable section 25*a* moves toward the closed position. As this occurs, the spring 90 acts against the now locked magazine case section 25*a* to urge the guide means (via the slide pin 69 and arched slot 70) and spring means (via pivot pin 33) to shift the columns of cartridges to a position engaging the button 85 and where the first column becomes aligned with the interface guide channel 21.

The first spring column then moves the first cartridge column upwardly along the guide means and into the aligned interface channel 21 until the channel becomes filled with cartridges.

Upward motion of the cartridges is allowed by the button 85. However, button 85 will not allow the guide means and spring means to shift further about the axis of the pivot pin 33 until the first cartridge column has been completely depleted and the bottom cartridge of the column leaves the guide fingers 66 and moves into the interface channel 21. When this happens, the biasing means 89 is released to pivot the cartridge columns again toward the interface channel 21 until a cartridge in the next successive cartridge column comes into abutment with the button 85. The cartridge, being held against lateral movement by the guide means, binds the guide means against the button 85 until the spring means moves the cartridge upwardly from engagement with the button into the interface channel 21. The next cartridge in the column simultaneously moves up to engage the button 85. The bottom cartridge of the column, when moved above the button, frees the guide and spring means for pivotal motion responsive to the biasing means such that another successive cartridge column is brought into alignment with the guide channel 21. This process is repeated until the entire magazine is again depleted of cartridges. The last column is depleted completely from the magazine by the extended interface follower which extends up into the interface channel 21, pushing the cartridges upwardly until the last one is discharged through the top opening 22.

It is pointed out that the above description is given by way of example to set forth the preferred form of the present invention. Other forms, which are not shown in the drawings, may be readily devised and which may fall within the scope of the following claims. For example, it is conceivable that the guide means (guide fingers 66) may be provided in connection with the spring means for translational movement therewith between the open (FIG. 13) and closed (FIGS. 4, 5) conditions. If this is done, loading of the cartridges may be accomplished without use of the stripping means 62. The cartridge box would then be placed over the open area of the magazine created by the retracted spring and guide means and held in a stationary position as the lid would be retracted. The cartridges would then drop from the box onto the inward cartridge receiving surface 73 of the case base 26. The cartridges would be supported on that surface until the guide means could be shifted back to capture the cartridges and hold them in the manner shown in FIG. 14. Other modifications may be envisioned as well.

In compliance with the statute, the invention has therefore been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A large capacity quick load magazine for firearm cartridges adapted to be mounted to the magazine well of a firearm and for receiving cartridges in bulk from a cartridge box, said magazine comprising:

a cartridge well interface means having a cartridge guide channel for receiving a column of cartridges and having a discharge opening;

a magazine case having an interface end joined to the interface means; said interface means being pivotally connected to said magazine case at the interface end thereof;

cartridge guide means within the magazine case having an open end for receiving a quantity of cartridges in a plurality of columns;

spring means associated with the guide means for selectively biasing columns of cartridges received by the cartridge guide means toward the interface means;

pivot means mounting the guide means and spring means within the housing for pivotal movement therein such that each column may be pivoted in succession into alignment with the cartridge guide channel of the interface; and access means for exposing the guide means for bulk cartridge charging directly from the cartridge box; and indexing means for actuating the pivot means to move successive columns into alignment with said cartridge guide channel in response to depletion of cartridges from columns previously aligned with said channel.

2. The magazine of claim 1 wherein said access means is comprised of:

a case cover mounted to the magazine case for movement between an operative position covering the cartridge guide means and an inoperative position exposing the magazine interior for bulk loading of cartridges.

3. The magazine of claim 1 wherein said access means is comprised of:

a case cover;

slide means mounting the case cover to the case for movement thereon between an operative position covering the cartridge guide means and an inoperative position exposing the cartridge guide means for bulk cartridge loading; and wherein said spring means is operatively mounted to the slide means for movement therewith between said operative and inoperative positions.

4. The magazine of claim 3 wherein said guide means is mounted to said case for slidable movement thereon in an arc about an axis.

5. The magazine of claim 1 further comprising locking means for selective operation to lock the case cover in the operative position.

6. The magazine of claim 1 wherein said cartridge spring means is slidably mounted to the magazine case for translational motion longitudinally with respect to said columns between an operative position within the case and an inoperative position spaced from said operative position.

7. The magazine of claim 6 wherein said spring means is comprised of a compression spring for each column of cartridges, mounted to the spring means for movement therewith between the operative and inoperative positions; and wherein the cartridge guide means is comprised of spaced fingers mounted to the case for receiving and gathering cartridges received within the case into said columns.

8. The magazine of claim 1 further comprising cartridge box lid stripping means for abutment with and removal of a slidably removable lid of the cartridge box.

9. The magazine of claim 1 further comprising means for receiving and guiding a cartridge box for translational movement relative to said cartridge guide means to open said cartridge box and allow cartridges to be fed into the cartridge guide means.

10. The magazine of claim 1 wherein said indexing means is comprised of:

biasing means for urging the guide means to pivot the columns of cartridges toward the cartridge guide channel;

a cartridge engaging abutment means adjacent the top open end of the guide means and said cartridge guide channel for releasably engaging successive cartridges of each cartridge column within the guide means as said cartridges are fed by said spring means to the guide channel to prevent pivotal movement of the guide means only so long as a cartridge remains in a column presently aligned with the guide channel and for permitting said biasing means to pivot the guide means to bring a successive column of cartridges into alignment with said guide channel only when cartridges have been emptied from said column presently aligned with the guide channel.

11. The magazine of claim 1 further comprising:

manually actuatable lockout means interconnecting the spring means and magazine case for selectively locking the spring means in an operative position within the case and for unlocking the spring means to permit motion thereof to an inoperative position projecting outward of the magazine case.

12. A large capacity quick load magazine for firearm cartridges adapted to be mounted to the magazine well of a firearm and for receiving cartridges in bulk from a cartridge box, said magazine comprising:

a cartridge well interface means having a cartridge guide channel for receiving a column of cartridges and having a discharge opening;

a magazine case having an interface end joined to the interface means;

cartridge guide means within the magazine case having an open end for receiving a quantity of cartridges in a plurality of columns;

spring means associated with the guide means for selectively biasing columns of cartridges received by the cartridge guide means toward the interface means;

pivot means mounting the guide means and spring means within the housing for pivotal movement therein such that each column may be pivoted in succession into alignment with the cartridge guide channel of the interface; and access means for exposing the guide means for bulk cartridge charging directly from the cartridge box;

indexing means for actuating the pivot means to move successive columns into alignment with said cartridge guide channel in response to depletion of cartridges from columns previously aligned with said channel;

cartridge box guide means on the magazine case for slidably receiving and guiding a cartridge box such that columns of cartridges within the box substantially align with columns defined by said guide means; and cartridge box lid stripping means adjacent the cartridge guide means for abutment with the slidably removable lid of the cartridge box and for stripping the lid from the box such that cartridges within the box may be received by the cartridge guide means.

13. A large capacity quick load magazine for firearm cartridges adapted to be mounted to the magazine well of a firearm and for receiving cartridges in bulk from a cartridge box, said magazine comprising:

a cartridge well interface means having a cartridge guide channel for receiving a column of cartridges and having a discharge opening;

a magazine case having an interface end joined to the interface means;

cartridge guide means within the magazine case having an open end for receiving a quantity of cartridges in a plurality of columns;

spring means associated with the guide means for selectively biasing columns of cartridges received by the cartridge guide means toward the interface means;

pivot means mounting the guide means and spring means within the housing for pivotal movement therein such that each column may be pivoted in succession into alignment with the cartridge guide channel of the interface; and access means for exposing the guide means for bulk cartridge charging directly from the cartridge box;

indexing means for actuating the pivot means to move successive columns into alignment with said cartridge guide channel in response to depletion of cartridges from columns previously aligned with said channel;

cartridge box lid stripping means adjacent the cartridge guide means for abutment with the slidably removable lid of the cartridge box and for stripping the lid from the box as the box is moved translationally over the guide means such that cartridges within the box may be shifted gravitationally from the box and received by the guide means.

14. A large capacity quick load magazine for firearm cartridges adapted to be mounted to the magazine well of a firearm and for receiving cartridges in bulk from a cartridge box, said magazine comprising:

a cartridge well interface means having a cartridge guide channel for receiving a column of cartridges and having a discharge opening;

a magazine case having an interface end joined to the interface means;

cartridge guide means within the magazine case having an open end for receiving a quantity of cartridges in a plurality of columns;

spring means associated with the guide means for selectively biasing columns of cartridges received by the cartridge guide means toward the interface means;

pivot means mounting the guide means and spring means within the housing for pivotal movement therein such that each column may be pivoted in succession into alignment with the cartridge guide channel of the interface; and access means for exposing the guide means for bulk cartridge charging directly from the cartridge box;

indexing means for actuating the pivot means to move successive columns into alignment with said cartridge guide channel in response to depletion of cartridges from columns previously aligned with said channel;

wherein said interface means is movably mounted to the magazine case at the interface end thereof and movable between a closed position spanning the case interface end and covering the open end of the cartridge guide means, and an open position clear of and exposing the open end of the cartridge guide means; and means for receiving and guiding a cartridge box for manual translational movement along said cartridge guide means and for opening said cartridge box during said movement, such that cartridges held therein may be transferred gravitationally to the cartridge guide means through the open end thereof.

15. A large capacity quick load magazine for firearm cartridges adapted to be mounted to the magazine well of a firearm and for receiving cartridges in bulk from a cartridge box, said magazine comprising:

a cartridge well interface means having a cartridge guide channel for receiving a column of cartridges and having a discharge opening;

a magazine case having an interface end joined to the interface means;

cartridge guide means within the magazine case having an open end for receiving a quantity of cartridges in a plurality of columns;

spring means associated with the guide means for selectively biasing columns of cartridges received by the cartridge guide means toward the interface means;

pivot means mounting the guide means and spring means within the housing for pivotal movement therein such that each column may be pivoted in succession into alignment with the cartridge guide channel of the interface; and access means for exposing the guide means for bulk cartridge charging directly from the cartridge box;

indexing means for actuating the pivot means to move successive columns into alignment with said cartridge guide channel in response to depletion of cartridges from columns previously aligned with said channel; and means for receiving and guiding a cartridge box for manual translational movement along said cartridge guide means and for opening said cartridge box during said movement, such that cartridges held therein may be transferred gravitationally to the cartridge guide means through the open end thereof.

16. A large capacity quick load magazine for firearm cartridges of the type supplied in a box and with the cartridges being held within said box in substantially parallel columns, each cartridge being elongated along an axis and having a rim at one end, said cartridges being axially removable rim first from said box, said magazine comprising:

a cartridge well interface means adapted to be releasably received within the cartridge well of a firearm, and having a cartridge guide channel formed therein for receiving a column of cartridges arranged with cartridge axes substantially parallel, said channel including an open top end adapted to discharge successive cartridges axially;

a hollow magazine case having a top end mounting said interface means;

access means on said case for receiving a cartridge box such that said cartridges can be axially transferred gravitationally from said box to said case;

cartridge guide means for receiving cartridges from said box and for aligning cartridges received through said access means into substantially parallel columns;

spring means within said case for engaging and biasing said cartridge columns toward the top end of the case;

indexing means for successively shifting said guide means and the columns of cartridges held by said guide means into alignment with said cartridge guide channel such that said successive columns of cartridges are urged to move through said channel by said spring means; and cartridge box lid removing means for removing the cartridge box lid responsive to relative translational motion of the cartridge box over the cartridge guide means such that cartridges within said box drop gravitationally to be received by the cartridge guide means.

17. The magazine of claim 16 wherein the access means includes an opening formed into said case for receiving said cartridge box.

18. The magazine of claim 16 further comprising:

slide means mounting the spring means for slidable movement between an operative position within the magazine case and an inoperative position outward of the case; and lockout means manually operable to lock the spring means in the operative position and to unlock the spring means thereby permitting movement thereof to the inoperative position.

19. The magazine of claim 16 further comprising cartridge box guide means for receiving and guiding a cartridge box for relative translational motion over said cartridge guide means such that columns of cartridges within said box substantially align with columns defined by said cartridge guide means.

20. A large capacity, quick loading magazine for firearm cartridges of the type supplied in bulk quantities within lid closed boxes, and with the cartridges in each box being unidirectionally oriented and axially removable from said box, said magazine comprising:

a magazine case having a cartridge discharge opening at a firearm interface end thereof;

cartridge loading means on said magazine case for progressively removing a cartridge box lid and for progressively receiving cartridges axially from said box as said box is opened, responsive to prescribed translational movement of said box lid relative to the box; and means for delivering each cartridge received by said loading means to said cartridge discharge opening.

21. The magazine of claim 20 wherein said loading means is comprised of:

a stationary box lid opening means on said magazine case for engaging and stripping the lid from the box in response to prescribed movement of said box.

22. The magazine of claim 21 wherein said loading means is further comprised of cartridge box guide means on said magazine case for supporting said cartridge box in relation to the box opening means.

23. A process for loading a firearm magazine having a box opening means and a cartridge receiving guide, with cartridges being loaded directly from a cartridge box having a box closure, the cartridges being unidirectionally oriented and axially removable from one side of said box by removal of said box closure, comprising the steps of:

orienting the magazine such that the cartridge receiving guide faces upwardly;

orienting said cartridge box such that said one side faces downwardly;

supporting the box on the magazine along a plane substantially parallel to and above the cartridge receiving guide; engaging the box closure against the box opening means on said magazine;

engaging the box closure against the box opening means on said magazine;

moving the box relative to the opening means along the plane over the cartridge receiving guide such that the closure is progressively opened by said opening means;

progressively dropping cartridges gravitationally and axially from the box and into the cartridge receiving guide means; and removing the box from said magazine.

24. The process as claimed by claim 23 wherein the step of moving the box relative to the opening means is accomplished by holding the closure and opening means stationary and moving the box translationally over the cartridge receiving guide.

25. The process as claimed by claim 23 wherein the step of dropping cartridges into the cartridge receiving guide is accomplished by:

removing axial support for the cartridges at an elevation above the guide less than the overall axial cartridge dimension such that the cartridges will drop only partially clear of the box to the guide.

26. A magazine for holding and dispensing cartridges to a firearm, comprising:

interface means having a cartridge guide channel for conveying a column of cartridges to a discharge opening adapted to convey the cartridges to the firearm;

a magazine case having an interface end connected to said interface means;

cartridge guide means movably mounted within the magazine case for pivotal motion therewithin and having an open end for receiving a quantity of cartridges in a plurality of columns;

a movable case section movably mounted to the magazine case;

a spring assembly mounted to the movable case section and adapted to interposition a plurality of spring elements into the cartridge guide means to bias columns of cartridges toward the interface means so that each column of cartridges is individually fed;

pivot means mounting the spring assembly to the movable case section to allow pivotal motion of the spring assembly and cartridge guide means during operation of the magazine;

access means for exposing the cartridge guide for loading;

indexing means for actuating the pivot means to move successive columns of cartridges into alignment with said cartridge guide channel in response to depletion of cartridges from columns previously aligned with said channel; and case locking means for fixing the movable case section relative to the magazine case.

27. The magazine of claim 26 wherein the interface means is movably connected to the magazine case.

28. The magazine of claim 26 wherein the interface means is pivotally connected to the magazine case.

29. The magazine of claim 26 wherein the interface means is movably connected to the magazine and adapted to allow installation of cartridges into the magazine while the interface means is mounted in a magazine well in said firearm.

30. The magazine of claim 26 wherein the interface means is pivotally connected to the magazine case and adapted to be locked into a closed position by said movable case section.

31. The magazine of claim 26 further comprising cartridge box unloading means for opening a cartridge box containing a plurality of cartridges.

32. The magazine of claim 31 wherein the cartridge box unloading means includes a box lid removing means which engages a box lid on said cartridge box when the cartridge box is moved relative to said magazine.

33. The magazine of claim 26 wherein said indexing means comprises an abutment formed on interior surfaces of the magazine case adjacent the interface end and is adapted to engage end surfaces of cartridges in a column being fed through the cartridge guide channel.

* * * * *

UNITED STATES PATENT AND TRADEMARK OFFICE

CERTIFICATE OF CORRECTION

PATENT NO. : 4,707,941

DATED : November 24, 1987

INVENTOR(S) : Peter M. Eastman

It is certified that error appears in the above-identified patent and that said Letters Patent are hereby corrected as shown below:

At Column 9, line 9, insert the word -relative- before the words "to one another";

At Column 9, line 25, delete the word "organic" and insert the word -organize- before the word "cartridges";

At Column 9, line 26, delete the word "column" and insert the word -columns- before the punctuation ".";

At Column 9, line 46, delete the word "catridge" and insert the word -cartridge- before the words "box lid stripping";

At Column 9, line 46, delete the word "catridge" and insert the word -cartridge- before the word "box";

At Column 10, line 41, insert the word -a- before the word "cartridge";

At Column 10, line 67, delete the word "engage" and insert the word -engages- before the word "and At Column 11, line 5, delete the word "to" and insert the word -of- before the word "pivot";

At Column 12, line 3, delete the "/" before the numeral "33";

At Column 12, line 6, delete the word "side" and insert the word -slide- before the word "outwardly";

At Column 12, line 10, delete the numeral "20" and insert the the numeral -29- after the word "means";

UNITED STATES PATENT AND TRADEMARK OFFICE

CERTIFICATE OF CORRECTION

PATENT NO. : 4,707,941

DATED : November 24, 1987

INVENTOR(S) : Peter M. Eastman

It is certified that error appears in the above-identified patent and that said Letters Patent is hereby corrected as shown below:

At Column 12, line 17, delete the word "express" and insert the word -- exposes -- before the word "the".

Signed and Sealed this

Twenty-fourth Day of May, 1988

*Attest:*

*Attesting Officer*

DONALD J. QUIGG

*Commissioner of Patents and Trademarks*